US005941728A

United States Patent [19]

Okabe et al.

[11] Patent Number: 5,941,728

[45] Date of Patent: Aug. 24, 1999

[54] COVER MEMBER OF PRESS-CONNECTING CONNECTOR

[75] Inventors: Toshiaki Okabe; Kentarou Nagai, both of Shizuoka, Japan

[73] Assignee: Yazaki Corporation, Tokyo, Japan

[21] Appl. No.: 08/805,727

[22] Filed: Feb. 25, 1997

[30] Foreign Application Priority Data

Mar. 1, 1996 [JP] Japan ..... 8-044929

[51] Int. Cl.[6] ..... H01R 4/24

[52] U.S. Cl. ..... 439/467

[58] Field of Search ..... 439/407, 399, 439/460, 465, 467, 596, 942

[56] References Cited

U.S. PATENT DOCUMENTS

| | | | |
|---|---|---|---|
| 5,380,220 | 1/1995 | Okabe | 439/942 |
| 5,415,562 | 5/1995 | Matsumoto et al. | 439/399 |
| 5,577,930 | 11/1996 | Dohlem et al. | 439/399 |
| 5,662,493 | 9/1997 | Reichle | 439/942 |

FOREIGN PATENT DOCUMENTS

| | | | |
|---|---|---|---|
| 63-96771 | 6/1988 | Japan . | |
| 4-21063 | 2/1992 | Japan . | |
| WO 87/01518 | 3/1987 | WIPO | 439/399 |

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

A cover member of a press-connecting connector for covering an opening portion of terminal receiving chambers formed in a connector housing, includes a plurality of sandwiching plates, for sandwiching wires, arranged side by side and in parallel to each other on a closed side surface of the cover member, and the sandwiching plates having thick portions formed so that a distance between the sandwiching plates is substantially equal to a outer diameter of the wires. Further, the thick portions may be formed partly on the sandwiching plates so that step portions are formed on boundaries between the thick portions and not-thick portions so as to abut against rear ends of the press-connecting terminals

9 Claims, 5 Drawing Sheets

COVER MEMBER OF PRESS-CONNECTING CONNECTOR

BACKGROUND OF THE INVENTION

1. Field of the Invention

This invention relates to a structure of a cover member of a press-connecting connector for covering an opening portion of terminal receiving chambers formed in a connector housing.

2. Background

In a press-connecting connector, generally, an opening portion is formed in an upper wall surface of a connector housing so that press-connecting terminals mounted in terminal receiving chambers are exposed to the outside in order to press-connect the press-connecting terminals to wires, respectively. After press-connecting the wires, the opening portion is closed by a cover member which is formed integrally with the connector housing.

A conventional press-connecting connector having such a cover member will be described with reference to FIGS. 8 and 9.

FIG. 8 is a perspective view showing a conventional press-connecting connector in a state in which a cover member is opened, and FIG. 9 is a perspective view showing the same conventional press-connecting connector in a state in which the cover member is closed.

A connector housing 1 made of a synthetic resin material has a plurality of separators 3 which are formed to be erected in parallel to each other in the connector housing 1 so as to form terminal receiving chambers 5 arranged side by side.

The connector housing 1 has an opening portion 7 through which the terminal receiving chambers 5 are exposed to the outside. The respective terminal receiving chambers 5 receive press-connecting terminals 9 each of which is formed from an electrically conductive metal plate by plate working. The press-connecting terminals 9 have U-shaped press-connecting blades 11 opened upwardly, respectively. The press-connecting blades 11 cut off respective covers of wires 13 pressed into the blades from the above to electrically connect to conductors of the wires 13, respectively.

Furthers the press-connecting terminals 9 have wire clamping portions 15 at rear ends thereof, respectively. After pressing the wires 13 into the press-connecting terminals 9, winding pieces 15*a* of the wire clamping portions 15 are wound on the outer circumferences of the wires 13 respectively to increase forces for holding the wires 13 in the press-connecting terminals 9, respectively.

The connector housing 1 has a cover member 19 formed at the opening portion 7 integrally with the connector housing 1 through thin hinge portions 17. As shown in FIG. 9, the cover member 19 is pivotable through the hinge portions 17, and closes the opening portion 7.

The cover member 19 has a plurality of sandwiching plates 21 which are arranged side by side on the closed side surface of the cover member 19 to receive between the wire clamping portions 15. When the cover member 19 closes the opening portion 7, the sandwiching plates 21 come between the wire clamping portions 15 respectively to limit shaking of the wire clamping portions 15 and to sort the wires 13 into an alignment state.

In the aforementioned structure of the press-connecting connector, the shaking of the wire clamping portions 15 is limited by the sandwiching plates 21 as shown in FIG. 10. However, for example, when the wires 13 are made to shake in the directions of the arrow a by external force, the covers of the wires 13 are bitten by rear end edge portions e of the wire clamping portions 15 which are in the fixed state. In the case where the shaking acts on the wires 13 for a long time, there is a risk that the covers of the wires 13 are cleft, the external force is exerted directly to the conductors of the wires 13 to make press-connecting junction unstable, and breaking of the conductors is caused.

Further, in the structure of the cover member 19, the sandwiching plates 21 are arranged on the opposite sides of the respective wire clamping portions 15 only to limit the shaking of the wire clamping portions 15. Accordingly, the structure of the cover member 19 cannot prevent the disengagement with the press-connecting terminals 9 which increases the terminal holding force directly.

SUMMARY OF THE INVENTION

The present invention has been achieved in view of the aforementioned circumstances, and an object thereof is to provide a structure of a cover member of a press-connecting connector, in which covers of wires can be prevented from being damaged at terminal edge portions due to the shaking of the wires, and further, a terminal holding force can be increased to prevent breaking of the wire and to increase the terminal holding force.

In order to achieve the foregoing object, a cover member of a press-connecting connector, for covering an opening portion of terminal receiving chambers formed in a connector housing, includes a plurality of sandwiching plates, for sandwiching wires arranged side by side and in parallel to each other, formed on a closed side surface of the cover member, the sandwiching plates having thick portions formed so that a distance between the sandwiching plates is substantially equal to an outer diameter of the wires.

In the above cover member, the thick portions may be partly formed on the sandwiching plates, and step portions are formed at boundaries between the thick portions and not-thick portions so as to abut against respective rear ends of press-connecting terminals.

In the above cover member, the sandwiching plates may be formed so as to be tapered off to the forward side in a closing direction to form the thick portions on base end sides of the sandwiching plates.

Further in the above cover member, protrusions for pressing the wires may be formed on wire contacting surfaces of the thick portions.

In the thus configured structure of the cover member of the press-connecting connector as described above, since the thick portions are formed in the sandwiching plates arranged side by side on the cover member such that a distance between the thick portions is substantially equal to an outer diameter of the wires, the shaking of the wires is limited to prevent the wires from biting edge portions of the press-connecting terminals when the wires are sandwiched between the thick portions.

Further, since the thick portions are formed partly on the sandwiching plates, and the step portions are formed on boundaries of the thick portions so as to abut against rear ends of the press-connecting terminals, the rear ends of the press-connecting terminals abut against the step portions to prevent coming off of the press-connecting terminals.

Further, since the sandwiching plates are shaped to be tapered so that the thick portions are formed on the base end side of the sandwiching plates, the wires each having a large outer diameter can deform along the tapered surfaces so that the wires are received in gaps between the sandwiching plates if each of the wires has an outer diameter larger than an ordinary outer diameter.

Furthermore, since the protrusions for pressing the wires are formed on the wire contact surfaces of the thick portions, the wires can be held in such a manner that the wires are pressed by the protrusions.

DETAILED DESCRIPTION OF THE PREFERRED EMBODIMENTS

Figure 8:
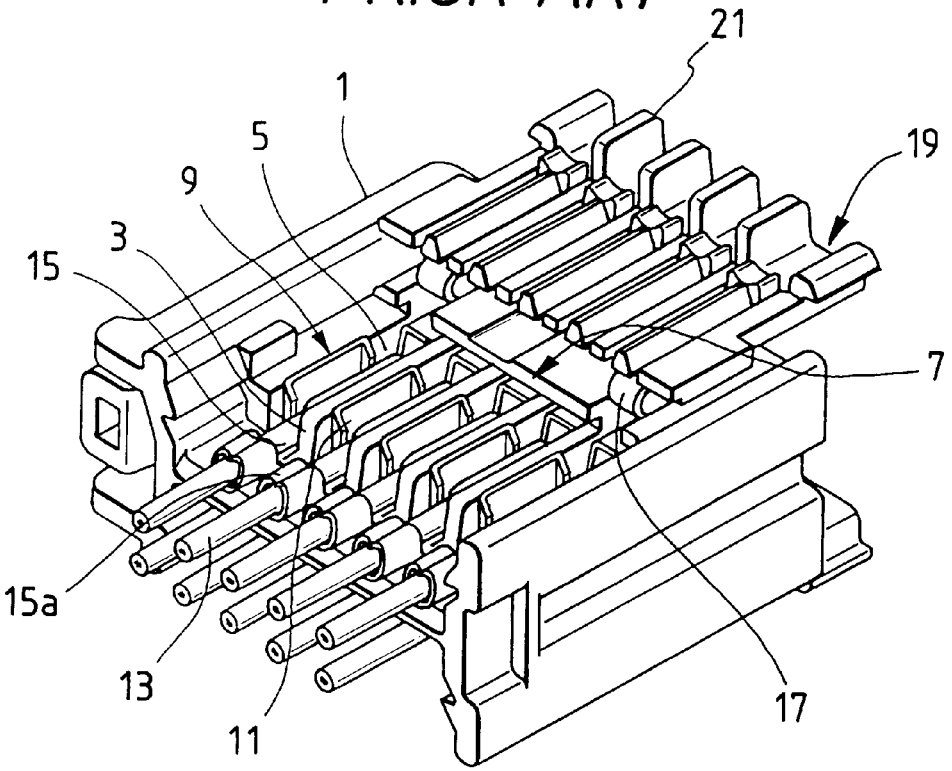
FIG. 8 PRIOR ART
FIG. 8 is a perspective view showing a conventional press-connecting connector in such a manner that a cover member is opened.
Figure 9:
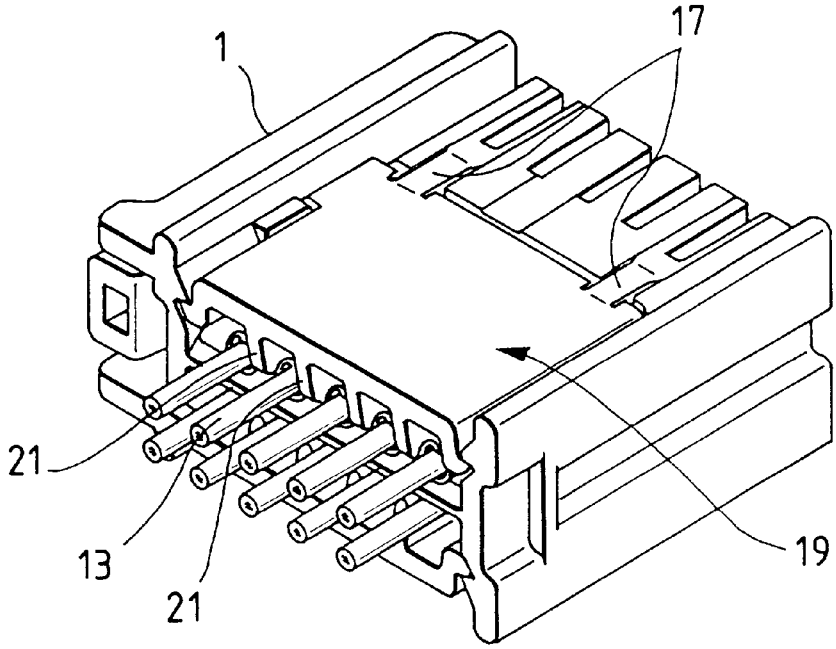
FIG. 9 PRIOR ART
FIG. 9 is a perspective view showing the conventional press-connecting connector in such a manner that the cover member is closed.
Figure 10:
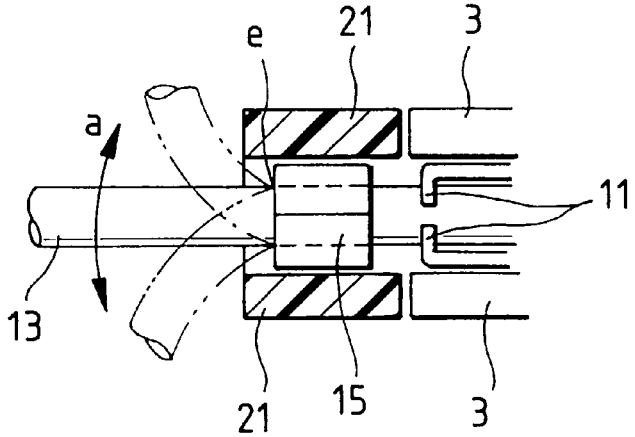
FIG. 10 PRIOR ART
FIG. 10 is a sectional view for explaining the state of the conventional cover member at the time of shaking of a wire.

Preferred embodiments of the structure of the cover member of the press-connecting connector according to the present invention will be described below in detail with reference to the drawings. Incidentally, in the embodiments, the same parts as shown in FIG. 8 are correspondingly referenced, and duplicated description is omitted here.

Figure 2:
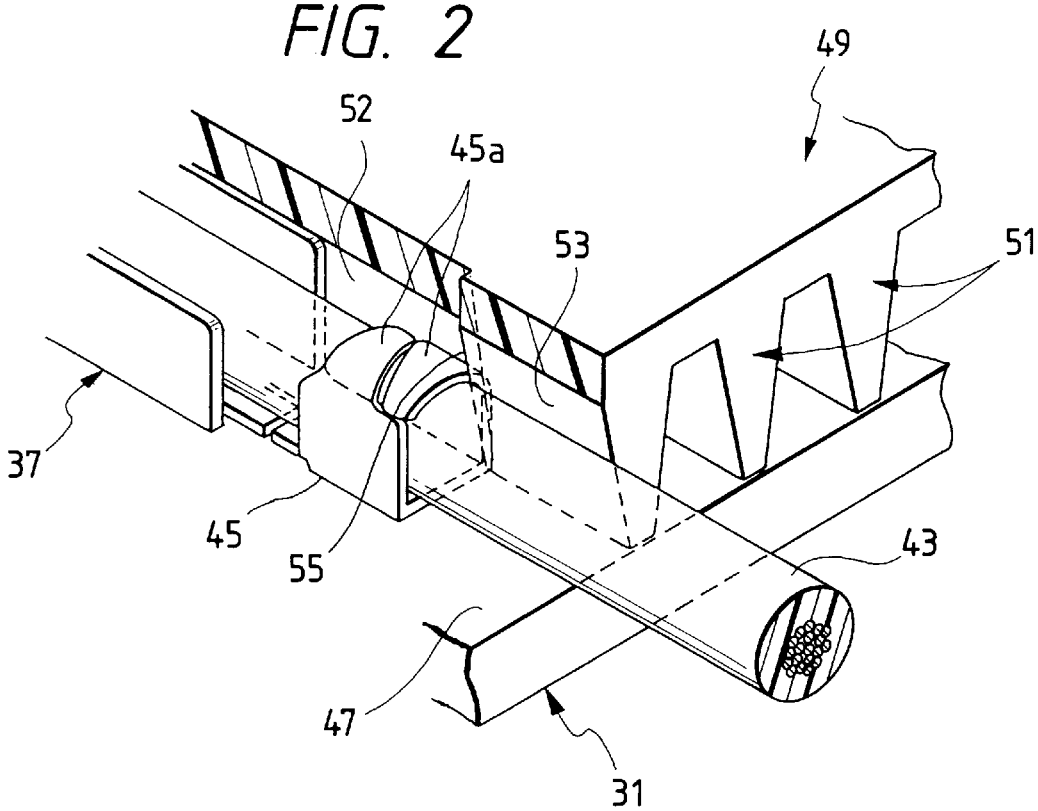
FIG. 2 is a perspective view showing a rear end portion of a connector housing in such a manner that the cover member in FIG. 1 is closed.

As shown in FIG. 2, a connector housing 31 made of a synthetic resin material is partitioned by separators 3 (see FIG. 8) of a plurality of terminal receiving chambers 5 arranged side by side. The terminal receiving chambers 5 have elastic lock pieces (not shown) for engaging press-connecting terminals 37 received in the terminal receiving chambers 5 to prevent disengagement the terminals.

An opening portion 7 (see FIG. 8) is formed in an upper wall surface of the connector housing 31 so that portions of the terminal receiving chambers 5 and a rear end portion of the connector housing 31 are exposed through the opening portion 7. Accordingly, since press-connecting blades of the press-connecting terminals 37 received in the terminal receiving chambers 5 are exposed to the outside, wires 43 can be press-connected from the outside. The press-connecting terminals 37 have wire clamping portions 45 at rear ends thereof, respectively. When the wires 43 are pressed into the press-connecting blades, a pair of winding pieces 45*a* of the wire clamping portions 45 are wound on the outer circumferences of the wires 43, respectively.

For example, the wire clamping portions 45 are arranged on the rear outer side of the separators 3 and on bottom plate portions 47 of the terminal receiving chambers 5. The connector housing 31 has a cover member 49 which is provided at the opening portion 7 so as to be freely closed through hinge portions (not shown). The cover member 49 has a plurality of sandwiching plates 51 which are arranged side by side and in parallel to each other on the closed side surface of the cover member. When the cover member 49 is closed, the sandwiching plates 51 come between the winding portions 45 and between the wires 43.

Accordingly, when the cover member 49 is closed, the sandwiching plates 51 sandwich the wire clamping portions 45 of the press-connecting terminals 37 and the wires 43 from their opposite sides. The sandwiching plates 51 have thick portions 53 at portions which sandwich the wires 43 respectively. Further, the sandwiching plates 51 have step portions 55 which are formed on boundaries between portions 52 which sandwich the wire clamping portions 45 and the portions (thick portions 53) which sandwich the wires 43.

The sandwiching plates 51 are designed such that a distance between the thick portions 53 is substantially equal to an outer diameter of the wires 43, and such that the step portions 55 abut against the rear end surfaces of the wire clamping portions 45 in such a manner that the thick portions 53 sandwich the wires 43.

Figure 1:
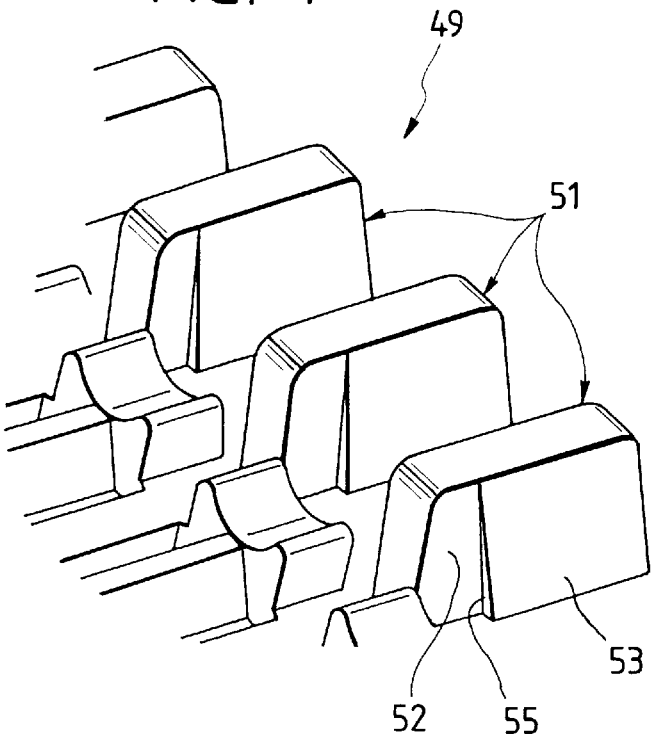
FIG. 1 is a perspective view showing a portion of sandwiching plates of a cover member according to the present invention.

As an example of the configuration of the thickness portions 53 formed in the sandwiching plates, the sandwiching plates 51 may be shaped so as to be tapered toward the forward ends respectively, as shown in FIGS. 1 and 2. That is, in the taper shape, at least the base end side of the sandwiching plates 51 can be formed as the thick portions 53 so that the step portions 55 between the thick portions 53 and not-thick portions 52 can abut the rear ends of the wire clamping portions 45.

Figure 3:
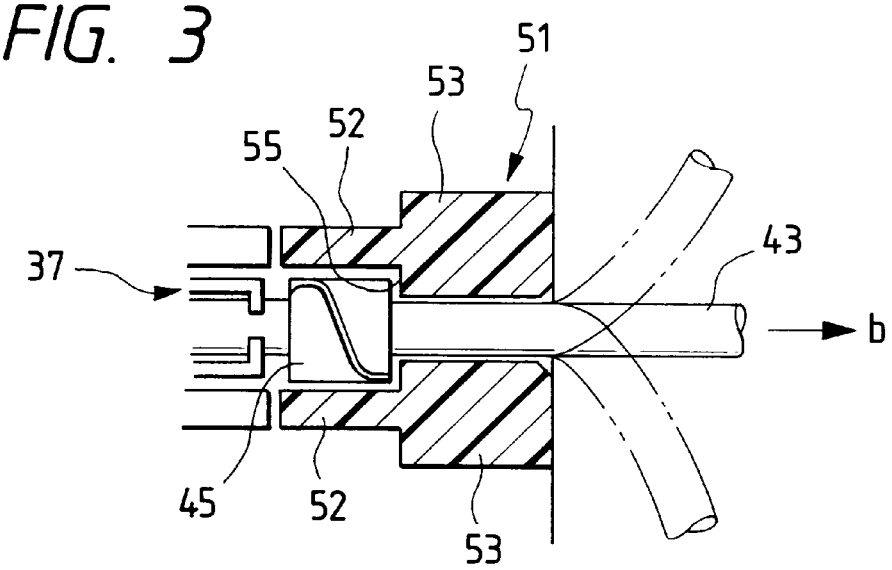
FIG. 3 is a sectional view for explaining a state of the cover member according to the present invention at the time of shaking of a wire.
Figure 4A:
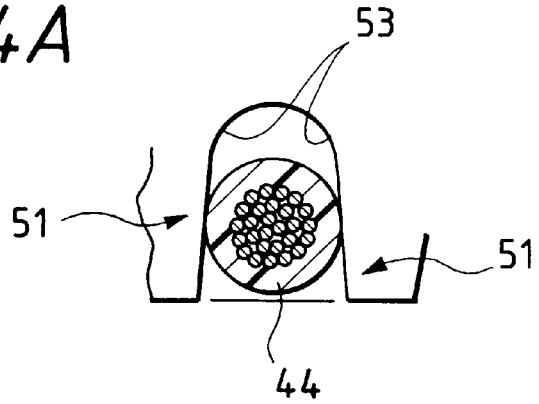
FIGS. 4A and 4B are explanatory views of one pair of the sandwiching plates showing the cases where wires having different outer diameters are sandwiched.
Figure 4B:
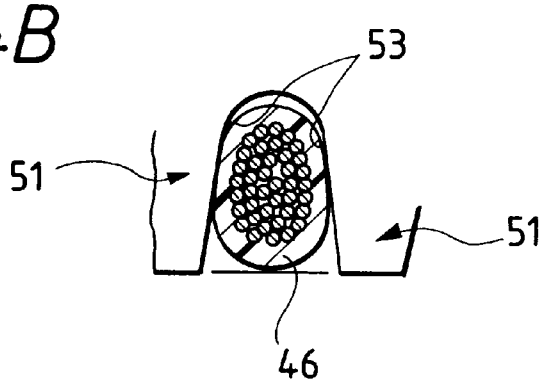

The operation of the cover member 49 configured as described above will be described with reference to FIGS. 2 through 4. FIG. 3 is a sectional view for explaining a state of the cover member 49 according to the present invention at the time of shaking of one of the wires 43, and FIGS. 4A and 4B are explanatory views of one pair of sandwiching plates 51 showing the cases where wires having different outer diameters are sandwiched.

When the cover member 49 is closed to cover the opening portion 7, wall portions 52 of the sandwiching plates 51 are disposed in opposite sides of each wire clamping portion 45 to limit the shaking of the wire clamping portions 45.

On the other hand, the thick portions 53 of the sandwiching plate 51 come between the wires 43. Since the thick portions 53 are designed so that the distance between the thick portions 53 is substantially equal to the outer diameter of the wires 43, the thick portions 53 sandwich the wires 43 to limit the shaking of the wires 43. The thick portions 53 limit the shaking of the wires 43 to prevent the wires 43 being bitten by the rear end edge portions of the wire clamping portions 45.

Further, the sandwiching plates 51 are designed such that the step portions 55 abut against the rear ends of the wire clamping portions 45 to prevent a movement of the press-connecting terminals 37 in the wire pulling-out direction (the direction of the arrow b in FIG. 3). As a result, the force for holding the press-connecting terminals 37 in the connector housing 31 is increased.

The sandwiching plates 51 tapered to form the thick portions 53 can sandwich wires of different sizes. For example, when the thick portions 53 are set so that the distance between the thick portions 53 is substantially equal to the outer diameter of a smallest used wire 44 as shown in FIG. 4A, the outer circumference of the wire 44 is sandwiched to limit the shaking of the wire 44. In the case of a wire 46 having the largest outer diameter, the wire 46 is deformed along the tapered surface as shown in FIG. 4B so that the wire 46 is received closely correspondingly to the form of the thick portions 53.

In the structure of the cover member of the press-connecting connector of the aforementioned embodiment, since the thick portions 53 are formed on the sandwiching plates 51, the wires 43 are sandwiched between the thick portions 53 to prevent the wires 43 from shaking and to prevent the wires 43 being bitten by the edge portions of the press-connecting terminals. Accordingly, damaging, breaking, or the like, of the covers of the wires can be prevented.

Further, since the step portions 55 are formed on the thick portions 58, the step portions 55 abut against the rear ends (rear ends of the wire clamping portions 45) of the press-connecting terminals 37 so that the press-connecting terminals 37 do not disengage from the terminal receiving chambers 5. Accordingly, the force for holding the press-connecting terminals 37 can be improved greatly.

Further, since the thick portions 53 are formed on the base end side of the sandwiching plates 51 by the tapered shape, a wire having a larger outer diameter can be deformed along the tapered surface so as to be received in the gap between the sandwiching plates 51. Accordingly, if wires 43 each have a different outer diameter, the sandwiching plates 51 can sandwich wires 43, respectively.

Figure 5:
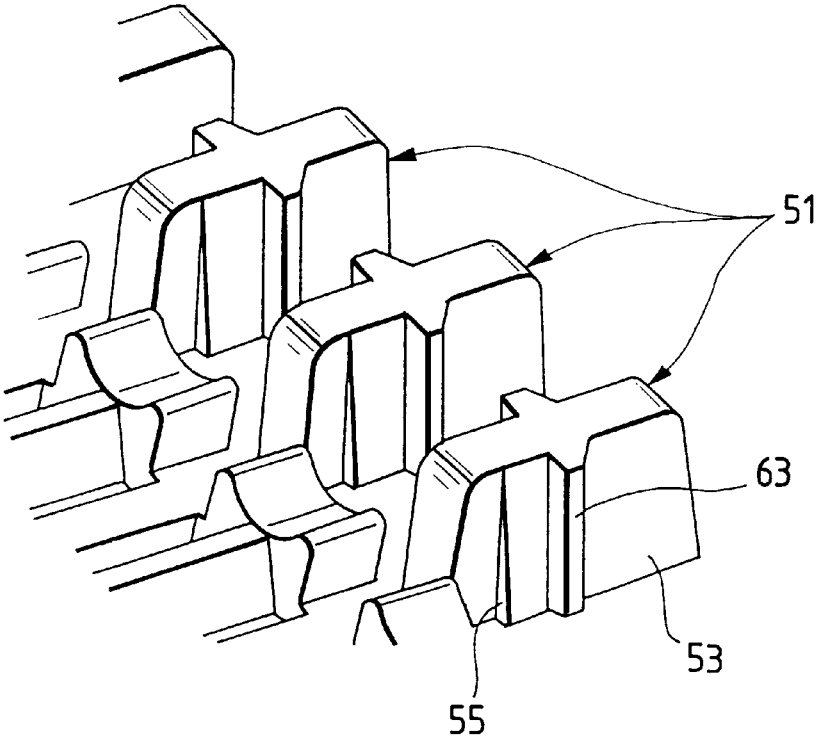
FIG. 5 is a perspective view showing sandwiching plates of a cover member according to another embodiment of the present invention.
Figure 6:
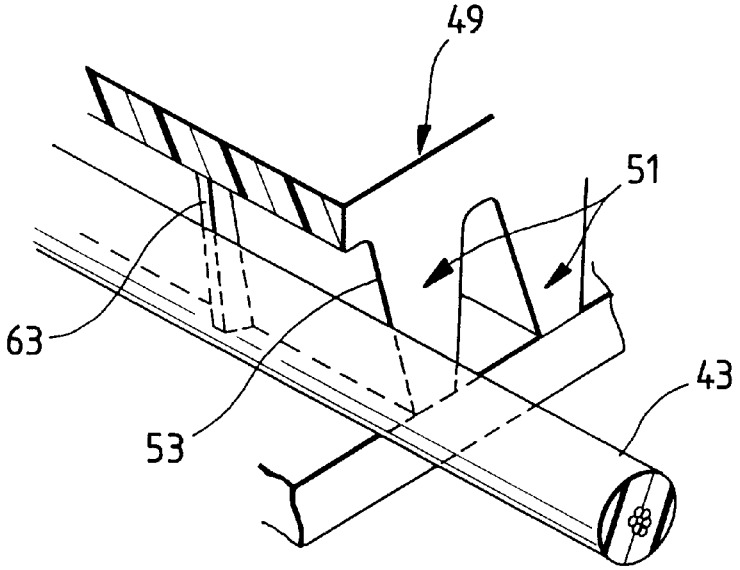
FIG. 6 is a perspective view showing a rear end portion of a connector housing in such a manner that the cover member in FIG. 5 is closed.
Figure 7:
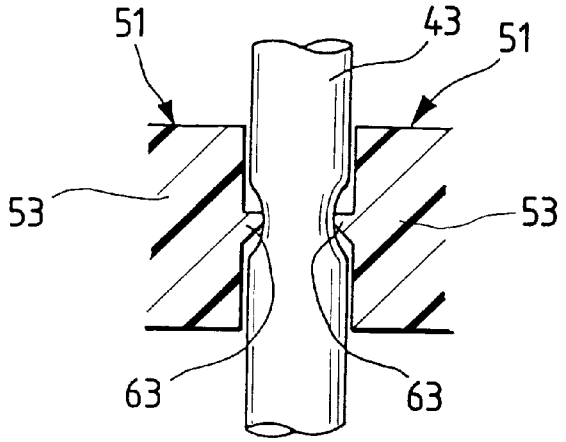
FIG. 7 is a sectional view of one pair of the sandwiching plates showing a sandwiched state by protrusions.

Another embodiment of a cover member according to the present invention will be described below with reference to FIGS. 5 through 7.

In the structure of the cover member according to this embodiment, the sandwiching plates 51 are shaped so as to be tapered in the same manner as in the previous embodiment so that thick portions 53 and step portions 55 are formed.

On the other hand, the sandwiching portions 51 have protrusions 63 on the wire sandwiching surfaces of the thick portions 53. The protrusions 63 are formed to project in a direction perpendicular to the center axes of the wires 43.

In the cover member configured as described above, when the cover 49 is closed, the thick portions 53 of the sandwiching portions 51 sandwich the wires 43 from their opposite sides. Accordingly, as shown in FIG. 7, the protrusions 63 deform the cables 43 partially in the form of concaves so that the cables 43 are sandwiched while being pressed.

According to the structure of the cover member of this embodiment, the sandwiching plates 51 are disposed so as to be brought into contact with the outer circumferences of the wires 43 in the same manner as in the previous embodiment to limit the shaking of the wires 43, so that the wires 43 can be prevented from being damaged by the edge portions, and further, the wires 43 can be sandwiched while being pressed by the protrusions 63. Accordingly, the force for holding the wires 43 can be increased.

Although the wires 43 can be sandwiched by the whole surfaces of the thick portions 53 if the distance between the thick portions 53 is set to be smaller than the outer diameter of the wires over the whole wire contact surfaces in order to increase the cable sandwiching force, a larger cover closing force is required in such a structure since the contact areas between the wires 43 and the sandwiching plates 51 are increased. On the contrary, in the cover member according to this embodiment, since the wires 43 can be deformed and pressed by the protrusions 63 with smaller contact areas, the force for holding the wires 43 can be increased without increasing the assembling force at the time of closing the cover member.

Although the aforementioned embodiment has shown the case where thick portions 53 and not-thick wall portions 52 are formed in the sandwiching plates 51 so that step portions 55 are formed between the thick portions 53 and the not-thick portions 52, the present invention is not limited to this but it is applicable to the case where the thick portions 53 are formed on the whole of the sandwiching plates 51. In this case, end surfaces of the sandwiching plates opposite to the press-connecting terminals 37 may be designed to abut against the rear ends of the terminals 37. Further, the sandwiching plates 51 for sandwiching the wire clamping portions 45 may be formed separately and independently.

As described above in detail, in the structure of the cover member of the press-connecting connector according to the present invention, thick portions are formed in sandwiching plates arranged side by side on a cover member so that a distance between the thick portions is substantially equal to an outer diameter of wires, the wires are sandwiched between the thick portions so that shaking of the wires can be prevented, and damaging, breaking, or the like, of the covers of the wires can be prevented.

Further, when thick portions are formed partly on the sandwiching plates so as to abut against the rear ends of the press-connecting terminals, the press-connecting terminals can be prevented from coming off, and further, a force for holding the press-connecting terminals can be improved.

Further, when the sandwiching plates are shaped to be tapered to the forward end side in the closing direction so that thick portions are formed on the base end side of the sandwiching plates, a wire having a larger outer diameter can be deformed along the tapered surface so that the wire can be received in the gap between the sandwiching plates. Accordingly, wires having different outer diameters can be sandwiched.

Furthermore, when protrusions for pressing the wires are formed on the wire contact surfaces of the thick portions, the wires can be sandwiched while being pressed by the protrusions so that the force for sandwiching the wires can be increased.

What is claimed is:

1. An electrical connector, comprising:

a housing including a plurality of terminal receiving chambers for receiving press-connecting terminals;

an opening portion formed in said housing to expose a part of said terminal receiving chambers;

a cover member for covering said opening portion; and a plurality of substantially triangular-shaped sandwiching plates for holding wires connected to said press-connecting terminals when said cover member closes said opening portion, said sandwiching plates being formed on said cover member, said sandwiching plates being arranged side by side and in parallel to each other, and said sandwiching plates having thick portions formed at base end sides of said sandwiching plates, said sandwiching plates being formed to progressively taper from said base end sides of said sandwiching plates to tapered blunt tips in a closing direction of said cover member, so that a distance between said sandwiching plates is substantially equal to an outer diameter of said wires.

2. The connector of claim 1, further comprising:

wall portions formed integrally with said thick portions, said wall portions having thin sectional portions which are thinner than sections of said thick portions, respectively; and step portions, for abutting against rear ends of wire clamping portions of said press-connecting terminals, defined by boundaries between said thick portions and said wall portions.

3. The connector of claim 2, wherein said thick portions have protrusions for compressing said wires, said protrusions being formed on contact surfaces of said thick portions and which contact said wires.

4. The connector of claim 2, wherein said thick portions sandwich said wires.

5. The connector of claim 1, further comprising:

step portions formed at boundaries between said thick portions and thin portions formed on said cover member so as to abut against respective rear ends of wire clamping portions of said press-connecting terminals.

6. The connector of claim 5, wherein said thick portions have protrusions for compressing said wires, said protrusions being formed on contact surfaces of said thick portions and which contact said wires.

7. The connector of claim 5, wherein said thick portions sandwich said wires.

8. An electrical connector, comprising:

a housing including a plurality of terminal receiving chambers for receiving press-connecting terminals;

an opening portion formed in said housing to expose a part of said terminal receiving chambers;

a cover member for covering said opening portion; and a plurality of sandwiching plates for holding wires connected to said press-connecting terminals when said cover member closes said opening portion, said sandwiching plates being formed on said cover member, said sandwiching plates being arranged side by side and in parallel to each other, and said sandwiching plates having thick portions formed at base end sides of said sandwiching plates, said sandwiching plates being formed to progressively taper from said base end sides of said sandwiching plates in a closing direction of said cover member, so that a distance between said sandwiching plates is substantially equal to an outer diameter of said wires;

wall portions formed integrally with said thick portions, said wall portions having thin sectional portions which are thinner than sections of said thick portions, respectively; and step portions, for abutting against rear ends of wire clamping portions of said press-connecting terminals, defined by boundaries between said thick portions and said wall portions;

wherein said step portions each has a triangular surface.

9. An electrical connector, comprising:

a housing including a plurality of terminal receiving chambers for receiving press-connecting terminals;

an opening portion formed in said housing to expose a part of said terminal receiving chambers;

a cover member for covering said opening portion; and a plurality of sandwiching plates for holding wires connected to said press-connecting terminals when said cover member closes said opening portion, said sandwiching plates being formed on said cover member, said sandwiching plates being arranged side by side and in parallel to each other, and said sandwiching plates having thick portions formed at base end sides of said sandwiching plates, said sandwiching plates being formed to progressively taper from said base end sides of said sandwiching plates in a closing direction of said cover member, so that a distance between said sandwiching plates is substantially equal to an outer diameter of said wires;

step portions formed at boundaries between said thick portions and thin portions formed on said cover member so as to abut against respective rear ends of wire clamping portions of said press-connecting terminals;

wherein said step portions each has a triangular surface.

* * * * *